US011617906B2

(12) United States Patent
Heusser et al.

(10) Patent No.: US 11,617,906 B2
(45) Date of Patent: Apr. 4, 2023

(54) MOUTH PROTECTION DEVICE FOR A RESPIRATORY PROTECTION SYSTEM

(71) Applicant: Optrel Holding AG, Wattwil (CH)

(72) Inventors: Jonathan Heusser, Uerikon (CH); Robert Buechel, Wattwil (CH); Daniel Bloechlinger, St. Gallenkappel (CH); Jasper Brouwer, Switzerland (CH)

(73) Assignee: OPTREL HOLDING AG, Wattwil (CH)

( * ) Notice: Subject to any disclaimer, the term of this patent is extended or adjusted under 35 U.S.C. 154(b) by 0 days.

(21) Appl. No.: 17/787,494

(22) PCT Filed: Dec. 18, 2019

(86) PCT No.: PCT/EP2020/087025
§ 371 (c)(1),
(2) Date: Jun. 20, 2022

(87) PCT Pub. No.: WO2021/123168
PCT Pub. Date: Jun. 24, 2021

(65) Prior Publication Data

US 2023/0039501 A1 Feb. 9, 2023

(30) Foreign Application Priority Data

Dec. 20, 2019 (EP) ..... 19218878

(51) Int. Cl.
*A62B 18/02* (2006.01)
*A62B 23/02* (2006.01)
(Continued)

(52) U.S. Cl.
CPC ..... *A62B 18/025* (2013.01); *A41D 13/1161* (2013.01); *A62B 18/084* (2013.01); *A62B 23/025* (2013.01)

(58) Field of Classification Search
CPC ..... A62B 18/00; A62B 18/006–025; A62B 18/08; A62B 18/084; A62B 18/088;
(Continued)

(56) References Cited

U.S. PATENT DOCUMENTS 642,166 A 1/1900 Sherman
5,460,174 A 10/1995 Chang
(Continued)

FOREIGN PATENT DOCUMENTS

FR 1003623 3/1952
JP S50131888 U 10/1975
(Continued)

*Primary Examiner* — Rachel T Sippel
(74) *Attorney, Agent, or Firm* — Womble Bond Dickinson (US) LLP

(57) ABSTRACT

A mouth protection device for a respiratory protection system, in particular a blower respiratory protection system, includes at least one mask base body which is configured to cover a mouth and/or nose region of a user and which delimits a breathing zone at least partially, and includes at least one breathing air supply line, which is connected to the mask base body and delimits at least one breathing air channel that ends in the breathing zone and is configured for guiding an active breathing air flow,
wherein the mask base body is made at least largely of a flexurally soft material, the mask base body being made at least largely of a textile material.

13 Claims, 6 Drawing Sheets

Figure 1:
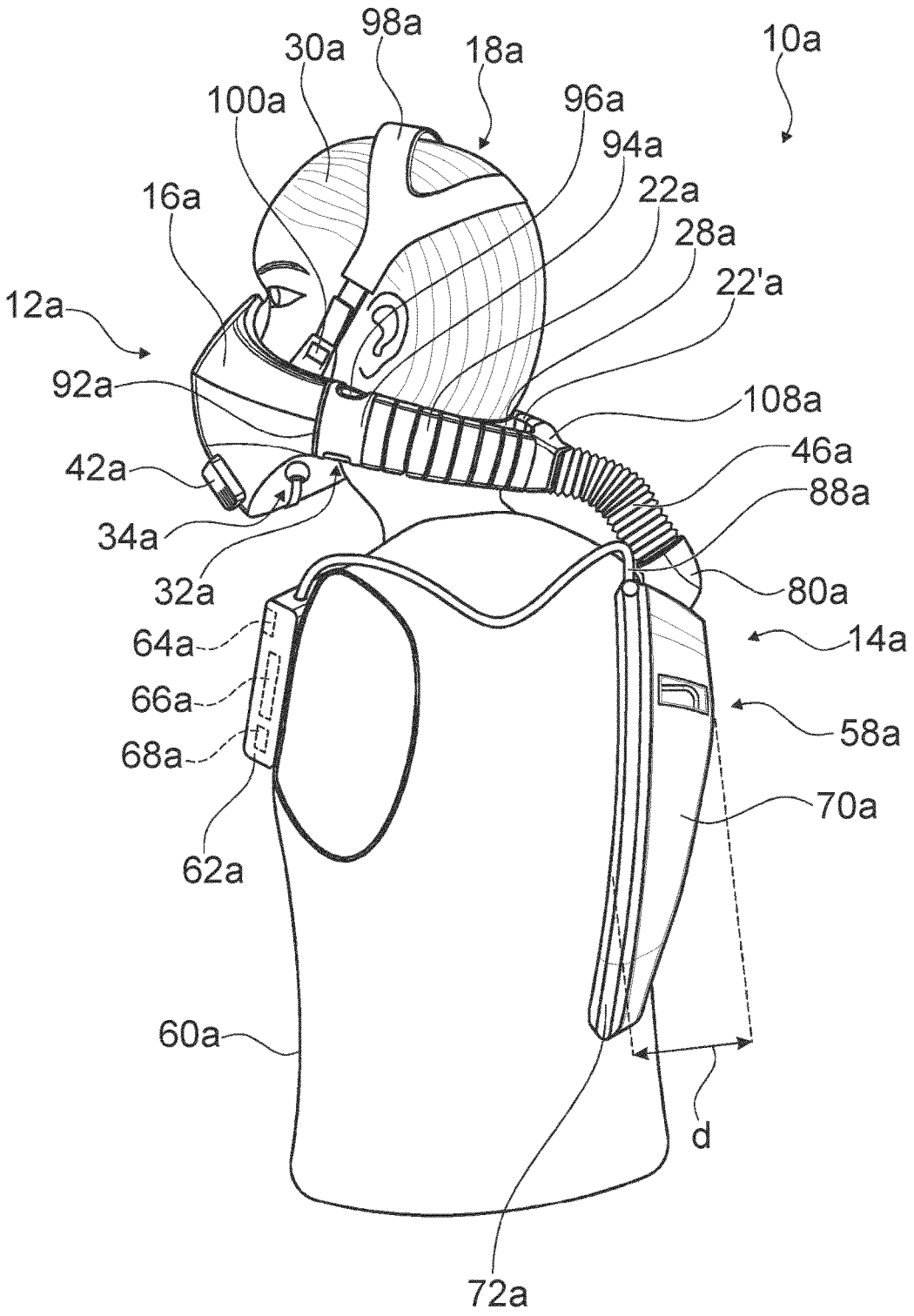

(51) Int. Cl.
*A62B 18/08* (2006.01)
*A41D 13/11* (2006.01)

(58) Field of Classification Search
CPC .. A62B 18/10; A62B 7/00; A62B 7/10; A62B 7/12; A62B 9/00; A62B 9/02; A62B 9/04; A62B 23/00–02; A61M 16/0057–0072; A61M 16/06–0655; A61M 16/105–106; A61M 16/107; A61M 16/20; A61M 16/208–209; A61M 2016/0661
See application file for complete search history.

(56) References Cited

U.S. PATENT DOCUMENTS

| | | | | |
|---|---|---|---|---|
| 2003/0217751 | A1* | 11/2003 | Patrick | A62B 18/084<br>128/205.27 |
| 2019/0166929 | A1* | 6/2019 | Bergman | A41D 13/1138 |

FOREIGN PATENT DOCUMENTS

| | | | |
|---|---|---|---|
| KR | 20040089827 | A | 10/2004 |
| KR | 100684335 | | 2/2007 |

* cited by examiner

MOUTH PROTECTION DEVICE FOR A RESPIRATORY PROTECTION SYSTEM

RELATED APPLICATIONS

The present application is the National Phase of International Application No. PCT/EP2020/087025 filed on Dec. 18, 2020, which claims priority to the benefit of European Patent Application no. 19218878.7 filed Dec. 20, 2019 and the disclosures of which are hereby incorporated herein by reference in their entireties.

PRIOR ART

The invention concerns a mouth protection device for a respiratory protection system.

A mouth protection device for a respiratory protection system, in particular a blower respiratory protection system, has already been proposed, with at least one mask base body which is configured to cover a user's mouth and/or nose region and which delimits a breathing zone at least partially, and with at least one breathing air supply line, which is connected to the mask base body and delimits at least one breathing air channel that ends in the breathing zone and is configured for guiding an active breathing air flow.

The objective of the invention is in particular to provide a generic device having improved characteristics regarding compactness and comfort. The objective is achieved according to the invention by the features of patent claim 1 while advantageous implementations and further developments of the invention may be gathered from the subclaims.

ADVANTAGES OF THE INVENTION

The invention is based on a mouth protection device for a respiratory protection system, in particular a blower respiratory protection system, with at least one mask base body which is configured to cover a user's mouth and/or nose region and which delimits a breathing zone at least partially, and with at least one breathing air supply line, which is connected to the mask base body and delimits at least one breathing air channel that ends in the breathing zone and is configured for guiding an active breathing air flow.

It is proposed that the mask base body is made at least largely of a flexurally soft material, the mask base body being made at least largely of a textile material. Preferably the mask base body is completely made of a flexurally soft material. It would however be conceivable that reinforcing elements are provided on and/or in the mask base body, which hold the mask base body at least partially in a defined basic shape. Preferably the mask base body is made of a textile.

A "respiratory protection system" is in particular to mean, in this context, a system with a blower device and with a mouth protection device, which is configured to actively provide an airflow for a breathing air supply of a user. The respiratory protection system is in particular configured, during operation, to create by means of a blower device an airflow which is fed to the mouth protection device of the respiratory protection system. Preferably the blower device is connected to the mouth protection device of the respiratory protection system via at least one breathing air supply line. Preferably the respiratory protection system is configured, in operation, by means of the blower device, to suck air from an environment, to purify the air, in particular to filter the air, and to actively feed the purified air to a user via the mouth protection device. By a "mouth protection device" is in particular, in this context, a device to be understood which forms a mouth protection and is configured to be worn at least in a user's mouth and/or nose region. Preferably the device is configured to form a breathing zone in front of the user's mouth and/or nose region, which is continuously supplied with breathing air during operation. Preferentially the mouth protection device is configured to directly supply a user with breathing air and to protect a user's mouth and/or nose region from external influences, in particular from gases, particles and/or suspended matter. Preferentially the mouth protection device is free of a cover of a user's eyes, in particular of a user's eye region.

Furthermore, a "mask base body" is in particular to mean, in this context, a base body of the mouth protection device that is configured for directly covering a user's mouth and/or nose region. The mask base body is in particular formed by a planar component, which is configured to extend over a user's mouth and/or nose region. Preferably the mask base body delimits a breathing zone, which is in an operation state formed by the mask base body and the face of the user. The breathing air supply line is in particular realized by a tube that is configured to delimit a breathing air channel. The breathing air supply line in particular connects a blower device of the respiratory protection system to the mask base body of the mouth protection device of the respiratory protection system. The breathing air channel is in particular configured for guiding a breathing air flow into the breathing zone, where the breathing air flow is configured, in operation, for supplying the user with air.

Preferably, a "flexurally soft component" is in particular to mean, in this context, a component, a planar component, which has flexurally soft characteristics at least in a direction that is perpendicular to a main extent direction. Preferably it is in particular to mean a dimensionally instable component. Particularly preferentially it is in particular to mean a component which in an extended state produces a counterforce against a pressure force that acts parallel to a main extent direction, said counterforce being smaller than a weight force of the component. Preferably the counterforce amounts to maximally 70%, preferably to maximally 50% and particularly preferentially to maximally 30% of a weight force. Different flexurally soft components are conceivable which are deemed expedient by someone skilled in the art, in particular, however, the flexurally soft component is realized at least partly or completely by a chain, a strap or a rope. Preferably, it is in particular to mean a component that differs from a rod or something like that. By a "planar component" is here in particular a component to be understood which in a laid-out state has a height extent that is manyfold smaller than a length extent and a transverse extent of the component. Preferably a height extent is less than 5 cm, preferentially less than 2 cm and particularly preferentially less than 1 cm. "Manyfold smaller" is here in particular to mean at least five times as small, preferably at least 10 times as small and particularly preferentially at least 20 times as small.

By a "textile material" is in particular, in this context, a material to be understood that is implemented of a textile raw material, like for example natural fibers and/or synthetic fibers, which is made into linear, planar and spatial shapes by a variety of methods. In particular, the textile material may additionally also comprise non-textile raw materials, which are made into linear, planar and spatial shapes together with the textile materials by a variety of methods. The mask base body is in particular at least largely made of a planar textile shape, like in particular a fabric, interlaced yarns, a knitted fabric, a netting, a meshed knitted fabric, a nonwoven material and/or a felt. "Configured" is in particular to mean specifically programmed, designed and/or equipped. By an object being configured for a certain function is in particular to be understood that the object fulfills and/or carries out said certain function in at least one application state and/or operation state. The term "at least largely" is here in particular to mean at least by 55%, advantageously at least by 65%, preferably at least by 75%, particularly preferentially at least by 85% and especially advantageously at least by 95%.

The implementation of the mouth protection device according to the invention in particular allows providing an advantageously flexible mouth protection device. It is in particular possible to provide a mouth protection device which adapts to a face shape. It is in particular possible to provide a mouth protection device for different shapes and sizes of faces. In particular, an advantageously high level of wearing comfort can be provided. This in particular allows obtaining an advantageously high comfort of the mouth protection device. Furthermore, an advantageously compact mouth protection device can be provided. In particular, it is thus also possible to provide an advantageously comfortable mouth protection device. It is in particular possible to provide a mouth protection device that is advantageously comfortable when worn. Furthermore, an advantageously lightweight mouth protection device can be provided.

It is further proposed that the mouth protection device comprises at least one further breathing air supply line, which is redundant to the breathing air supply line, which is connected with the mask base body and which delimits at least one further breathing air channel that ends in the breathing zone and is configured for guiding an active breathing air flow. Preferably the further breathing air supply line has a function that is redundant to the breathing air supply line. The further breathing air supply line in particular serves to increase a safety of a supply with the breathing air flow. Preferentially the breathing air supply line and the further breathing air supply line are in each case functional independently from each other. This in particular allows ensuring supply with the breathing air flow also in the case of a clogged and/or squeezed-off breathing air supply line or further breathing air supply line. The breathing air supply line and the further breathing air supply line are in particular guided on a user in different ways so as to avoid simultaneous squeezing of the breathing air supply lines.

Moreover, it is proposed that the at least one further breathing air supply line is arranged on a side of the mask base body that faces away from the breathing air supply line. Preferably the breathing air supply lines are configured to be guided along on different sides of the user's head. Preferably the breathing air supply lines are in each case connected to the mask base body at opposite ends of the mask base body, respectively. The breathing air supply lines are in particular configured to be guided on opposite sides of the user's neck. Preferably the mask base body has an at least approximately elliptic shape, the breathing air supply lines being respectively connected to the mask base body in one of the two outer principal vertices of the ellipse. In this way it is in particular possible to ensure a supply with the breathing air flow also in the case of a clogged or squeezed-off breathing air supply line or further breathing air supply line. The breathing air supply line and the further breathing air supply line are in particular guided on a user in different ways so as to avoid simultaneous squeezing of the breathing air supply lines. It is in particular possible to provide an advantageously redundant breathing air supply.

It is further proposed that the mouth protection device comprises at least one fastening strap for fixing the mask base body on a user's head, and at least one connection unit for a simultaneous plug-in connection of the fastening strap and the at least one breathing air supply line to the mask base body. Preferably the fastening strap is in particular implemented by an elastic strap, like in particular a rubber strap. Preferentially the fastening strap in particular has a width at least approximately corresponding to a width of the breathing air supply line. Preferably an effective length of the fastening strap is realized so as to be adjustable. The fastening strap in particular extends from a first end of the mask base body to an opposite-situated second end of the mask base body. The fastening strap in particular extends from a first end of the mask base body, in which the breathing air supply line is connected with the mask base body, to an opposite-situated second end of the mask base body, in which the further breathing air supply line is connected with the mask base body. By a "connection unit" is in particular, in this context, a unit to be understood which forms an interface for an—in particular toollessly—releasable coupling of the fastening strap and the at least one breathing air supply line with the mask base body. The connection unit in particular enables a multiple coupling and uncoupling, executed by an operator, of the fastening strap and the at least one breathing air supply line with the mask base body. The connection unit in particular serves for a pulling off or taking off the mouth protection device. A coupling may herein be brought about, for example, by a plugging movement, by a rotary movement and/or by a combination of a plugging and a rotary movement. Preferably the connection unit comprises at least one first coupling element and at least one second coupling element that corresponds to the first coupling element. Preferentially a first coupling element forms an interface receptacle while the second coupling element forms an interface projection. The first coupling element is in particular fixedly connected with the mask base body. The second coupling element is in particular fixedly connected with the fastening strap and the at least one breathing air supply line. In particular, the first coupling element is embodied by a tube connection. Preferably the mouth protection device comprises two connection units, in particular a first connection unit for the breathing air supply line and a second connection unit for the further breathing air supply line. In this way in particular an advantageously simple releasing of the mouth protection device is achievable. It is in particular achievable that both the fastening strap and the breathing air supply line can be released via only one connection unit. Preferably this in particular allows ensuring that the mouth protection device can only be worn with a connected breathing air supply line as the mouth protection device cannot be worn without the fastening strap and the fastening strap cannot be coupled with the mask base body without the breathing air supply line.

It is also proposed that the mouth protection device comprises at least one adjusting unit, wherein at least an effective length of a side edge of the mask base body is implemented so as to be at least partially adjustable by means of the adjusting unit. Preferably, an effective length of a side edge from a first end to a second end of the mask base body is implemented so as to be at least partially adjustable. Preferentially the side edge extends at least substantially parallel to a main extent direction of the mask base body. Preferably the adjusting unit in particular comprises a cord, in particular an elastic cord, and a cord clamp. The cord of the adjusting unit in particular runs in a channel of the mask base body from the first end of the mask base body to the second end of the mask base body, which is situated opposite the first end. The cord is in particular fastened at the first end and at the second end. In particular, an effective length of the cord, and thus of the side edge of the mask base body, is implemented so as to be manually adjustable by means of the cord clamp. In particular, an effective length of the cord is implemented so as to be manually adjustable by the formation of differently sized loops of the cord by means of the cord clamp. By a "main extent direction" of an object is herein in particular a direction to be understood which runs parallel to a longest edge of a smallest geometric rectangular cuboid just still completely enclosing the object. This in particular allows achieving an advantageously simple and comfortable adjustability of the mouth protection device, in particular of the mask base body. In particular, this allows adapting the mouth protection device to different sizes of faces.

Beyond this it is proposed that the mouth protection device comprises at least one separating layer, which is connected to the mask base body and is configured to at least partially separate the breathing zone from an outlet region, the outlet region being at least partially delimited by the mask base body. Preferably the outlet region is arranged at least below the breathing zone. In an operation state, the mask base body in particular delimits, together with the user's face, a spatial region which is divided into a breathing zone and an outlet region by the separating layer. The separating layer is in particular realized integrally with the mask base body. Preferably the separating layer has in a middle region a recess connecting the breathing zone to the outlet region. "Integrally" is in particular to mean at least connected by substance-to-substance bond, for example by a welding process, a gluing process, an injection-molding process and/or a different process that is deemed expedient by someone skilled in the art, and/or advantageously formed in one piece, like for example by a production from a cast and/or by a production in a one-component or multi-component injection-molding procedure and advantageously made of a single blank, or firmly sewed. This in particular enables an advantageous air guidance. Furthermore, in particular an at least partial separation of breathing air and breathed-out air is achievable.

It is further proposed that the separating layer is at least substantially made of a textile material. This in particular allows providing an advantageously flexible mouth protection device. In particular, a mouth protection device can be provided for different shapes and sizes of faces. In particular, an advantageously high level of wearing comfort can be provided. It is furthermore possible to provide an advantageously lightweight mouth protection device.

Furthermore it is proposed that the separating layer is configured for a defined air guidance, wherein the separating layer is configured to guide the breathing air flow past a user's mouth and/or nose region before the breathing air flow reaches the outlet region. For this purpose, the separating layer preferably has in its middle region a recess connecting the breathing zone to the outlet region. Preferably the breathing air flow flows during operation from the breathing air channel into the breathing zone and from the breathing zone through the recess into the outlet region. The recess is preferably arranged in a proximity of a user's mouth and/or nose region. In this way in particular an advantageous air guidance is achievable. Furthermore, in particular an at least partial separation of breathing air and breathed-out air is achievable.

it is also proposed that the mouth protection device comprises at least one discharge valve, which is configured to regulate a pressure in the breathing zone to an at least approximately constant value. Preferably, the discharge valve is in particular implemented by an overpressure valve, in particular a one-way overpressure valve, which is configured to open in excess of a defined overpressure in the breathing zone and/or in the outlet region, relative to an environment. Preferably the discharge valve is in particular implemented by a mechanical valve. In particular, the mask base body is not completely sealed with respect to the user's face, such that air may also leave at a transition from the mask base body to the face, besides the discharge valve. If there is too much leakage or if the mouth protection device is taken off, it is in particular conceivable that at the transition from the mask base body to the face the pressure in the breathing zone drops below the limit value of the discharge valve and the pressure drops. Under regular conditions, the pressure in the breathing zone is regulated to an at least approximately constant value by means of the discharge valve. This in particular allows providing an advantageously reliable mouth protection system. In particular, a constant pressure can be provided. Furthermore, it is in particular possible to monitor a tightness of the system on the basis of the pressure.

Beyond this it is proposed that the mask base body comprises at least one subregion which is implemented so as to be air-permeable. The subregion is in particular made of an air-permeable textile. Preferentially the subregion adjoins the outlet region. The subregion in particular serves for a defined discharge of air in the outlet region. During operation, there is an overpressure in the outlet region with respect to an environment, such that air is discharged only from the outlet region to the environment. The subregion is in particular provided in addition to the discharge valve; it would however also be conceivable that only the subregion is provided. It would in particular be conceivable that a pass-through quantity could be controlled via a tightness of the subregion. This in particular allows providing an advantageously reliable mouth protection system. In particular, a defined exit point can be created. It is in particular possible to avoid inadvertent air leakage.

The invention is furthermore based on a respiratory protection system, in particular a blower respiratory protection system, with the mouth protection device and with at least one blower device for a generation of a breathing air flow. It is proposed that the at least one blower device is configured to create an overpressure in the mouth protection device. Preferably the at least one blower device is configured to create in the mouth protection device a relative overpressure with respect to an environment. By a "blower device" is in particular, in this context, a device to be understood which is configured for an active generation of an airflow for supplying a user with breathing air. The blower device is in particular configured, in operation, to feed the airflow to the mouth protection device of the respiratory protection system. Preferably the blower device is connected to the mouth protection device of the respiratory protection system via at least one breathing air supply line. Preferably the blower device is configured, in operation, to suck air from an environment, to purify the air, in particular to filter the air, and to actively feed the purified air to a user, in particular via the mouth protection device. Preferentially the blower device is configured to generate an active airflow. The blower device is in particular configured to generate an overpressure airflow. The fan is in particular configured, during operation, for an active generation of an airflow. In particular, the fan is configured for an active suction of air from an environment and for an active transport of the air to the mouth protection device of the respiratory protection system. The fan is in particular implemented by an axial fan. This in particular allows providing an advantageously comfortable respiratory protection system. In particular, a reliable breathing air supply is enabled.

It is also proposed that the at least one blower device is configured to create a volume flow of the breathing air flow of at least 50 l/min and maximally 250 l/min. Preferably the blower device comprises a fan for generating an airflow. The fan is in particular configured to actively generate an airflow during operation. The fan is in particular configured for an active suction of air from an environment and for an active transport of the air to the mouth protection device of the respiratory protection system. The fan is in particular implemented by an axial fan. Preferably the fan is configured to create a volume flow of the airflow of at least 80 l/min and maximally 120 l/min. This in particular allows providing an advantageously compact high-performance blower device.

Moreover it is proposed that the respiratory protection system comprises at least one breathing air line, which is connected with the blower device, which is configured to guide the breathing air flow and is configured to divide the breathing air flow to the breathing air supply line and the further breathing air supply line. Preferably the breathing air line is directly connected to a breathing air outlet of the blower device. Preferentially the breathing air line is coupled with the breathing air supply line and the further breathing air supply line via a T-connection piece. In this way in particular an advantageous dividing of the breathing air flow is enabled.

The mouth protection device according to the invention and/or the respiratory protection system according to the invention shall herein not be limited to the application and implementation described above. In particular, in order to fulfill a functionality that is described here, the mouth protection device according to the invention and/or the respiratory protection system according to the invention may comprise a number of individual elements, components and units that differs from a number given here. Furthermore, in regard to the value ranges given in the present disclosure, values situated within the limits mentioned shall also be considered as disclosed and as applicable according to requirements.

DRAWINGS

Further advantages will become apparent from the following description of the drawings. In the drawings two exemplary embodiments of the invention are illustrated. The drawings, the description and the claims contain a plurality of features in combination. Someone skilled in the art will purposefully also consider the features separately and will find further expedient combinations.

Figure 2:
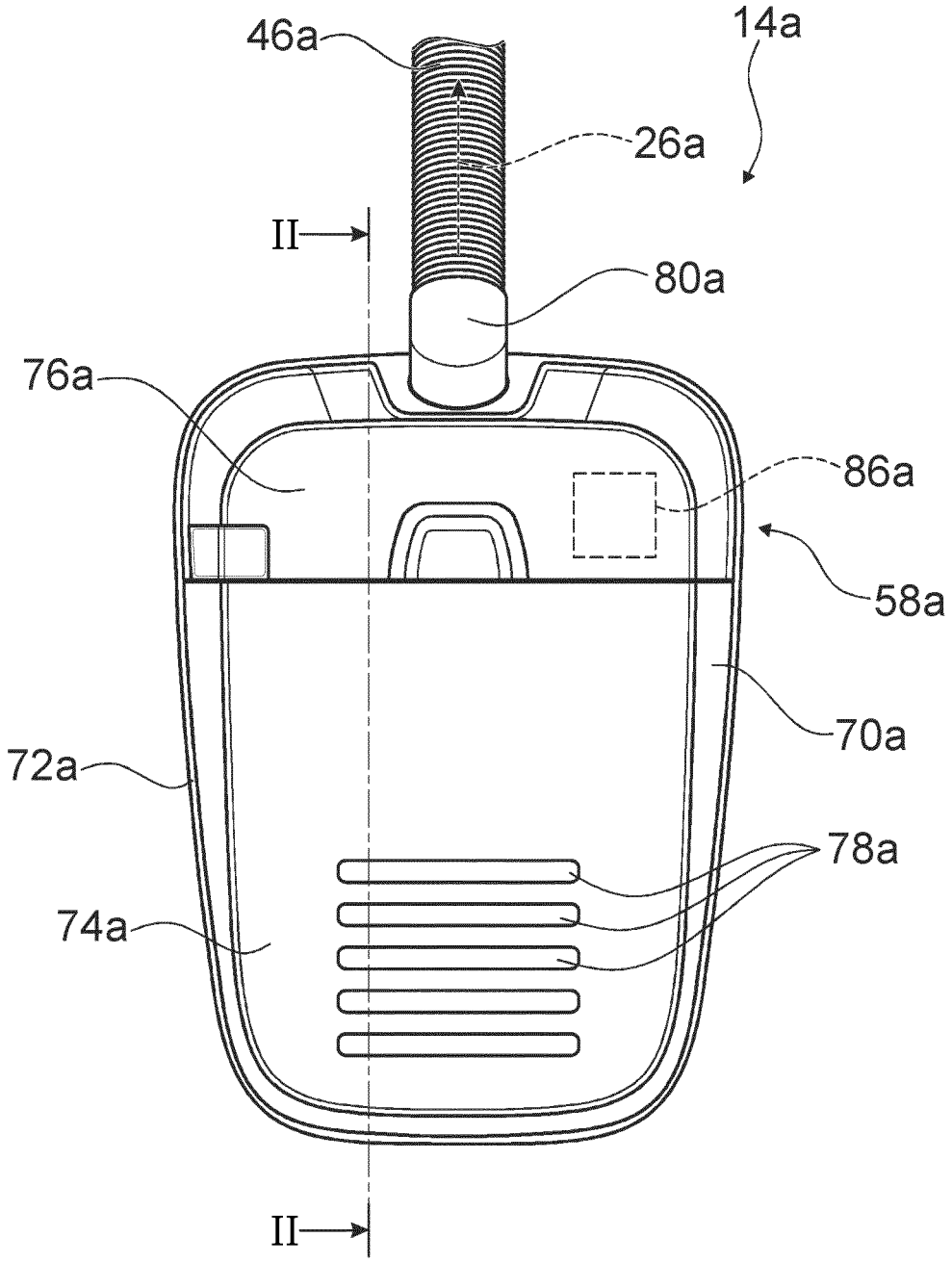
Figure 3:
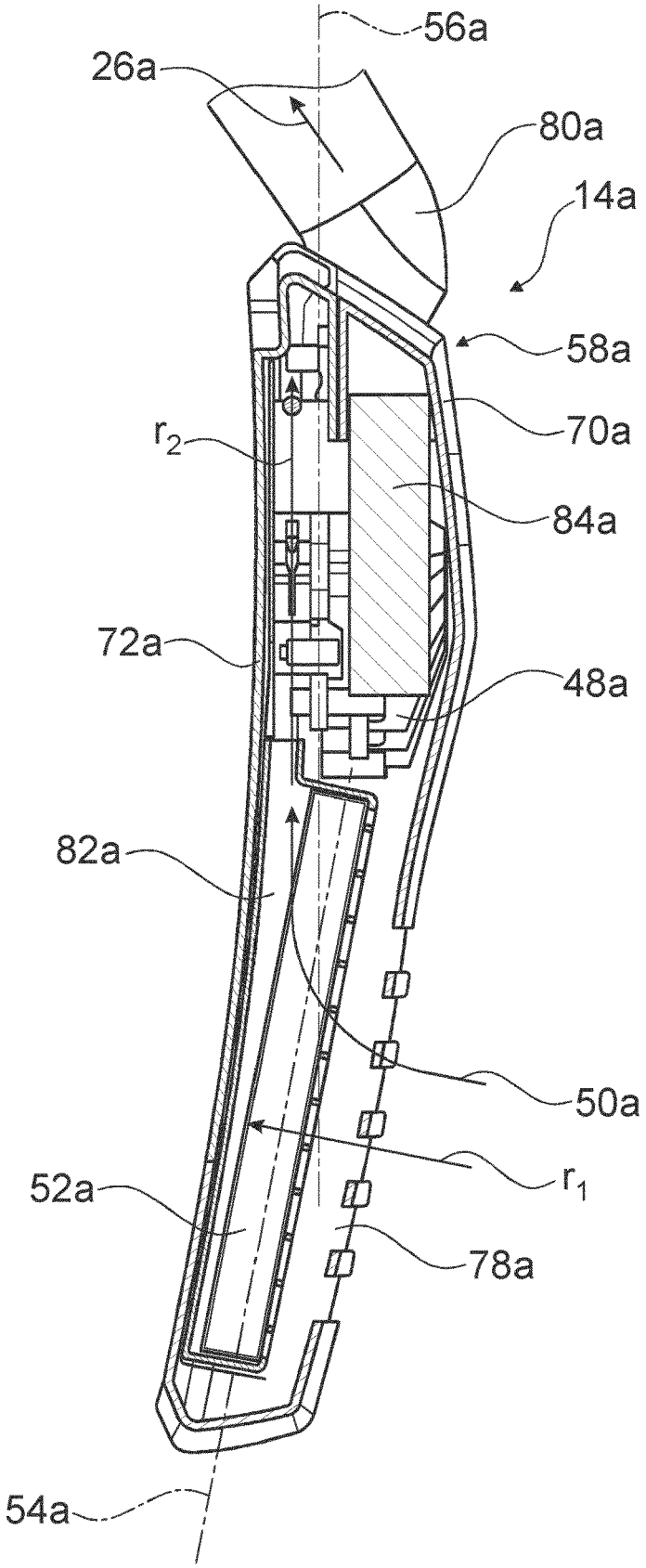
Figure 4:
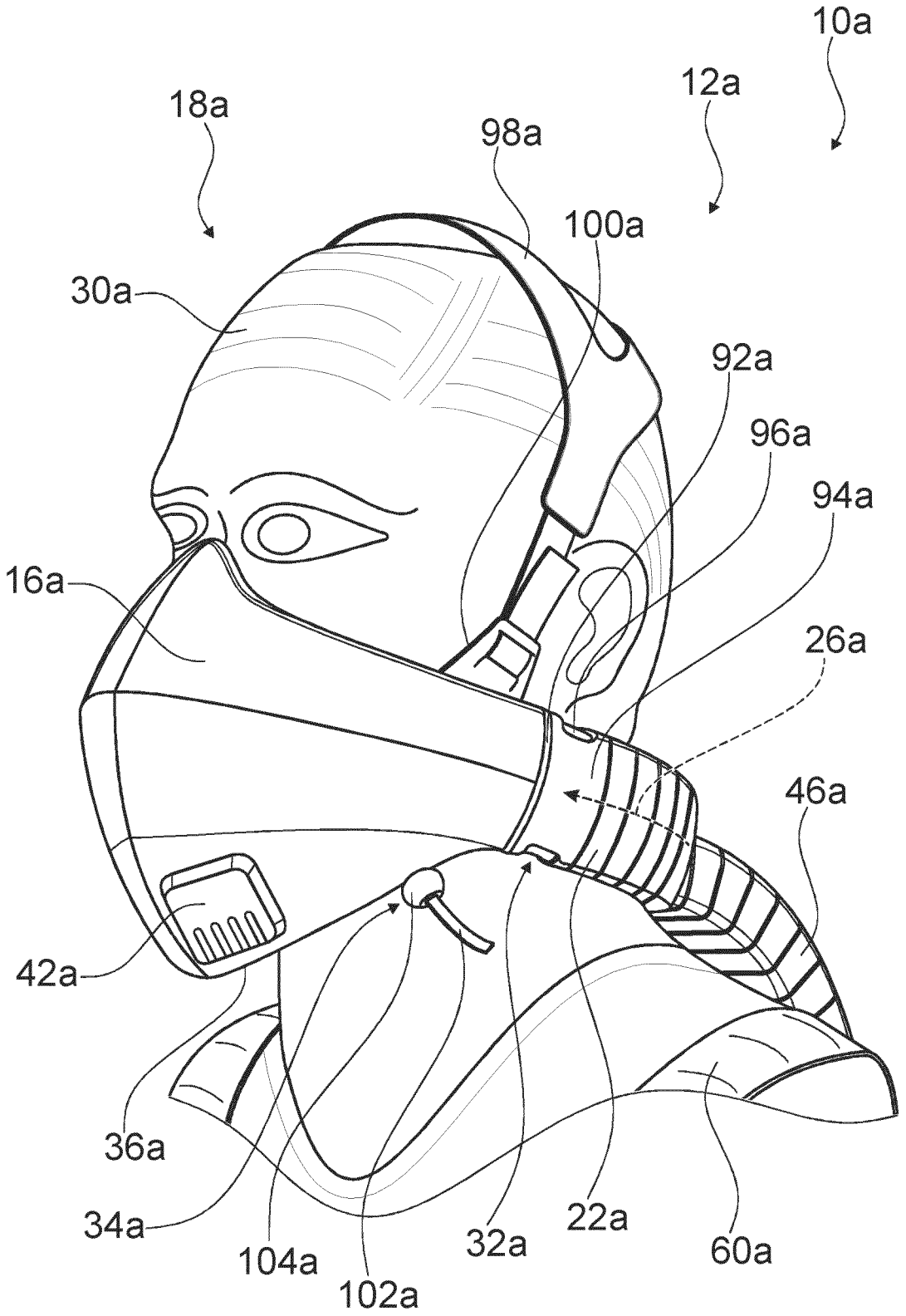
Figure 5:
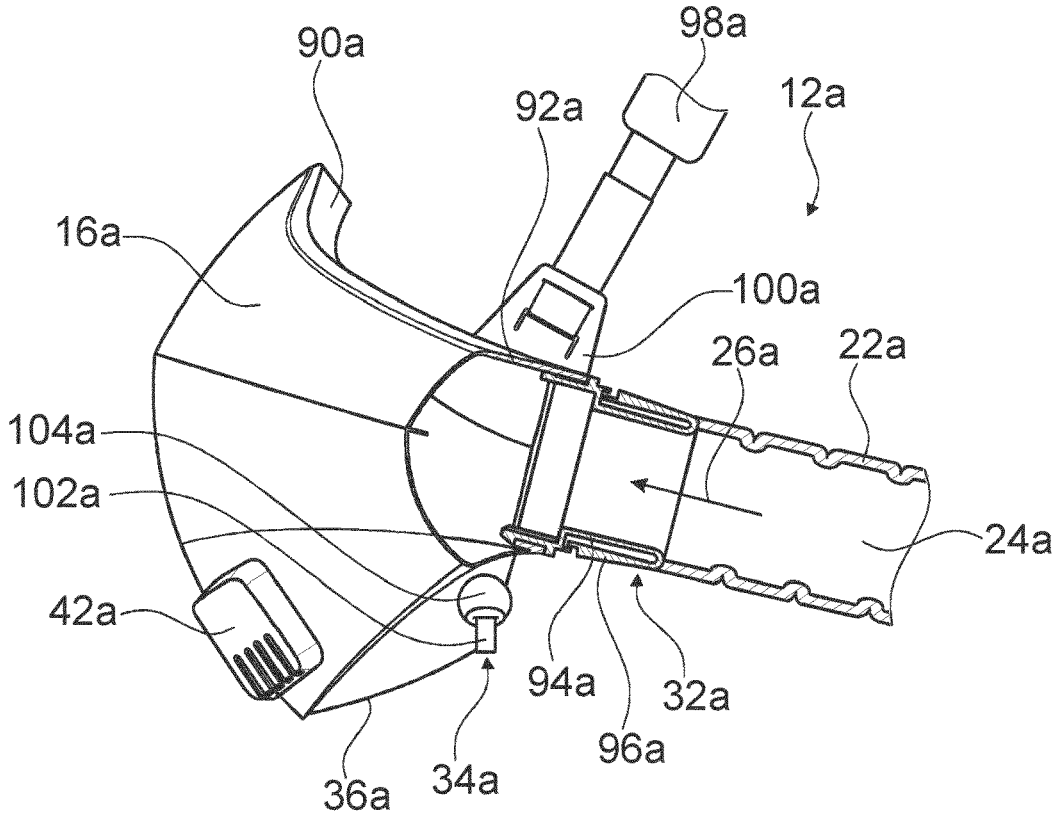
Figure 6:
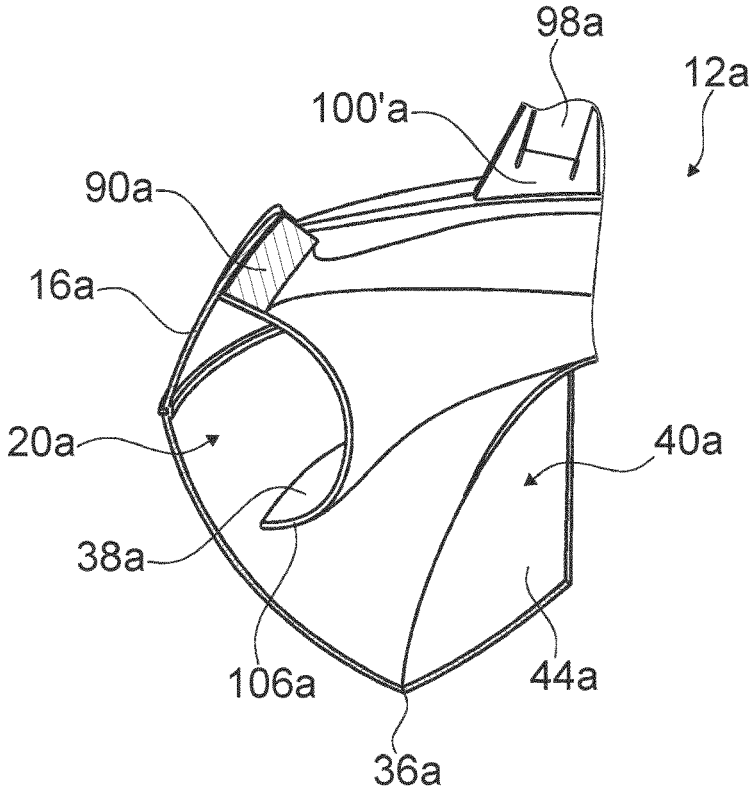
Figure 7:
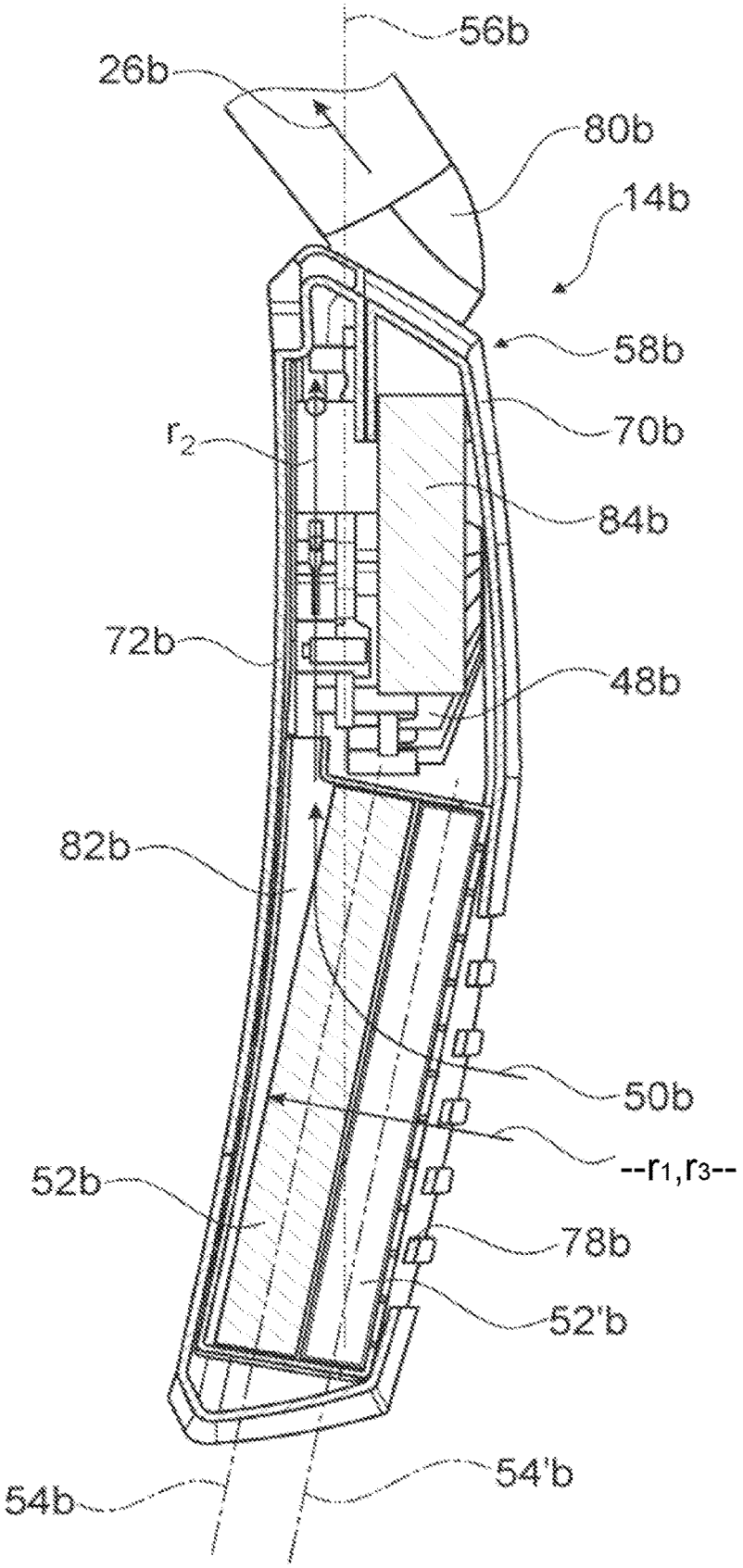

It is shown in:

FIG. 1 a respiratory protection system with a blower device, with a mouth protection device, with a vest and with an external operating unit, and a user, in a schematic illustration, FIG. 2 the blower device of the respiratory protection system in a schematic illustration, FIG. 3 the blower device of the respiratory protection system, with a fan and with a filter element, in a schematic sectional view along the section line II-II, FIG. 4 the mouth protection device of the respiratory protection system and the user's head, in a schematic illustration, FIG. 5 the mouth protection device of the respiratory protection system, in a schematic partial sectional view, FIG. 6 a portion of the mouth protection device of the respiratory protection system, in a schematic sectional view, and FIG. 7 an alternative blower device of a respiratory protection system, with a fan, with a filter element and with a further filter element, in a schematic sectional view.

DESCRIPTION OF THE EXEMPLARY EMBODIMENTS

FIG. 1 shows a respiratory protection system 10*a*. The respiratory protection system 10*a* is realized by a blower respiratory protection system. The respiratory protection system 10*a* is in particular realized by a blower respiratory protection system of safety class TH3.

The respiratory protection system 10*a* is configured for a protection of a user 18*a* from particles like smoke, aerosols and/or dust. Furthermore, the respiratory protection system 10*a* is in addition capable of protecting from unpleasant smells and noxious ozone. It is in particular conceivable that in environments with insalubrious or even toxic gases, the respiratory protection system 10*a* protects the user 18*a* from organic, inorganic and/or acidic gases. The respiratory protection system 10*a* comprises a blower device 14*a* and a mouth protection device 12*a*. The blower device 14*a* is configured to generate a breathing air flow 26*a*. The blower device 14*a* is configured to generate a breathing air flow 26*a* for the mouth protection device 12*a*.

The blower device 14*a* comprises a housing unit 58*a*. The housing unit 58*a* is realized by a plastic housing. The housing unit 58*a* comprises two housing shells 70*a*, 72*a*, namely a first housing shell 70*a* and a second housing shell 72*a*, which are connected to each other. The first housing shell 70*a* comprises two openable covers 74*a*, 76*a*, via which an inner space of the housing unit 58*a* can be made accessible. The second housing shell 72*a* forms a rear side of the housing unit 58*a*, which faces toward the user 18*a* in a state when it is worn. The second housing shell 72*a* is concavely curved on an outer side. The curvature of the second housing shell 72*a* is adapted to a back curvature of a human. The housing unit 58*a* further comprises several air inlet openings 78*a*. The air inlet openings 78*a* are implemented by slits in the first housing shell 70*a*. In operation, the air inlet openings 78*a* serve for suctioning an ambient air via an airflow 50*a*. Furthermore, the housing unit 58*a* comprises an air outlet opening 80*a*. The air outlet opening 80*a* is realized by a tube connection piece at the first housing shell 70*a*. In operation, the air outlet opening 80*a* serves for an output of the purified airflow 50*a*, in particular a breathing air flow 26*a*. In operation, the breathing air flow 26*a* is forwarded from the air outlet opening 80*a* to the mouth protection device 12*a* (FIGS. 1, 2).

The housing unit 58*a* has a thickness d of less than 70 mm. The housing unit 58*a* has a thickness d of less than 50 mm.

The blower device 14*a* further comprises a fan 48*a* for a generation of an airflow 50*a*. The blower device 14*a* is configured to create an overpressure in the mouth protection device 12*a*. The fan 48*a* is configured to create an overpressure in the mouth protection device 12*a*. The fan 48*a* is configured to create a volume flow of the airflow 50*a* of at least 50 l/min and maximally 250 l/min. The fan 48*a* is configured to create a volume flow of the airflow 50*a* of at least 80 l/min and maximally 120 l/min. During operation, the blower device 14*a* is configured to create in the mouth protection device 12*a*, by means of the fan 48*a*, a relative overpressure with respect to an environment. The fan 48*a* is embodied by an electrical radial fan. However, principally a different implementation, deemed expedient by someone skilled in the art, would also be conceivable. The fan 48*a* is arranged in the housing unit 58*a*. A main extent plane 56*a* of the fan 48*a* extends at least substantially parallel to a main extent plane of the housing unit 58*a*. The fan 48*a* is arranged in an upper region of the blower device 14*a*. The air outlet opening 80*a* is arranged on an exit side of the fan 48*a*. The blower device 14*a* further comprises a control and/or regulation unit 86*a* for a control and/or regulation of the fan 48*a* during operation. The control and/or regulation unit 86*a* is in particular configured to automatically adapt a performance grade of the fan 48*a*. The control and/or regulation unit 86*a* is configured to adjust an air flow level of the fan 48*a* depending on a saturation of a filter element 52*a*. Furthermore, the control and/or regulation unit 86*a* is configured for an automatic airflow control and airflow adaption (FIG. 3).

The blower device 14*a* also comprises the filter element 52*a*. The filter element 52*a* is configured to be flown through by the airflow 50*a*. The filter element 52*a* is implemented by a rectangular-cuboid-shaped filter module. The filter element 52*a* is implemented by an aerosol filter. The filter element 52*a* is embodied as a depth filter, in particular as a lamellate filter. It would however also be conceivable that the filter element 52*a* is implemented as a gas filter, in particular as an A1B1E1 gas filter. The filter element 52*a* is arranged in the housing unit 58*a*. A main extent plane 54*a* of the filter element 52*a* extends at least substantially parallel to a main extent plane of the housing unit 58*a*. The filter element 52*a* is arranged in a lower region of the blower device 14*a*. The housing unit 58*a* accommodates the fan 48*a* and the filter element 52*a*. On an entry side of the filter element 52*a*, the air inlet opening 78*a* is arranged. Furthermore, the filter element 52*a* is implemented so as to be exchangeable via the cover 74*a* (FIG. 2, FIG. 3).

The fan 48*a* is arranged next to the filter element 52*a*, the airflow 50*a* being deflected between the fan 48*a* and the filter element 52*a*. The filter element 52*a* and the fan 48*a* are together arranged in the housing unit 58*a*. The housing unit 58*a* further comprises an air conveying channel 82*a*, which accommodates the filter element 52*a* and which is configured to guide the airflow 50*a* between the filter element 52*a* and the fan 48*a*. The filter element 52*a* is arranged along the airflow 50*a* fluidically upstream of the fan 48*a*. The airflow 50*a* between the fan 48*a* and the filter element 52*a* is deflected by at least approximately 90°. A deflection of the airflow 50*a* is brought about in the air conveying channel 82*a*. However, it would also be conceivable that an air conveying channel 82*a* can be dispensed with. A flow-through direction $r_1$ of the airflow 50*a* through the filter element 52*a* is substantially different from a flow-through direction $r_2$ of the airflow 50*a* through the fan 48*a*. The flow-through direction $r_2$ of the airflow 50*a* through the fan 48*a* runs parallel to the main extent plane 56*a* of the fan 48*a*. In an implementation of the fan 48*a* as an axial fan it would, however, also be conceivable that the flow-through direction $r_2$ of the airflow 50*a* through the fan 48*a* runs perpendicularly to the main extent plane 56*a* of the fan 48*a*. The flow-through direction $r_1$ of the airflow 50*a* through the filter element 52*a* runs perpendicularly to the main extent plane 54*a* of the filter element 52*a*. The flow-through direction $r_1$ of the filter element 52*a* is angled by at least approximately 90° with respect to the flow-through direction $r_2$ of the fan 48*a* (FIG. 3).

The filter element 52*a* has the main extent plane 54*a*. The fan 48*a* has the main extent plane 56*a*. It would be conceivable that the main extent plane 54*a* extends parallel to the main extent plane 56*a*, wherein a distance between the main extent plane 54*a* of the filter element 52*a* and the main extent plane 56*a* of the fan 48*a* is smaller than a maximum thickness of the filter element 52*a*. Preferentially, in the case of a parallel implementation, a distance between the main extent plane 54*a* of the filter element 52*a* and the main extent plane 56*a* of the fan 48*a* would be smaller than 50 mm, preferably smaller than 30 mm and particularly preferentially smaller than 10 mm. In the illustrated implementation the main extent plane 54*a* of the filter element 52*a* is angled with respect to the main extent plane 56*a* of the fan 48*a*. An angle included by the main extent plane 54*a* of the filter element 52*a* and the main extent plane 56*a* of the fan 48*a* amounts to more than 80°, preferably more than 120° and particularly preferentially more than 160°. The angle included by the main extent plane 54*a* of the filter element 52*a* and the main extent plane 56*a* of the fan 48*a* amounts to at least approximately 165°. A normal vector of the main extent plane 54*a* of the filter element 52*a* that intersects with the filter element 52*a* and a normal vector of the main extent plane 56*a* of the fan 48*a* that intersects with the fan 48*a* include a smallest angle of at least approximately 15°. Preferably the main extent plane 56*a* of the fan 48*a* and the main extent plane 54*a* of the filter element 52*a* include a smallest angle of at least 60°, preferably at least 70°, with an imaginary plane in which the section line between the main extent plane 56*a* of the fan 48*a* and the main extent plane 54*a* of the filter element 52*a* runs and which is situated symmetrically between the filter element 52*a* and the fan 48*a*. Preferentially a section line of the main extent plane 54*a* of the filter element 52*a* and the main extent plane 56*a* of the fan 48*a* runs in a proximity of the filter element 52*a* and of the fan 48*a*. A smallest distance between the section line and the filter element 52*a* is in particular smaller than 15 cm, preferably smaller than 10 cm and particularly preferentially smaller than 5 cm. A smallest distance between the section line and the filter element 52*a* is smaller than a smallest distance between the fan 48*a* and the filter element 52*a*. At least a large portion of normal vectors of the main extent plane 54*a* of the filter element 52*a* that intersect with the filter element 52*a* are free of an intersection point with the fan 48*a*. All normal vectors of the main extent plane 54*a* of the filter element 52*a* that intersect with the filter element 52*a* are free of an intersection point with the fan 48*a*. The filter element 52*a* and the fan 48*a* are partially arranged at an angle next to each other (FIG. 3).

The blower device 14*a* further comprises an energy storage 84*a*. The energy storage 84*a* is embodied by an accumulator. The energy storage 84*a* serves for an energy supply of the fan 48*a*. A main extent plane of the energy storage 84*a* extends at least substantially parallel to a main extent plane of the housing unit 58*a*. The energy storage 84*a* is arranged in a lower region of the blower device 14*a*. The housing unit 58*a* accommodates the fan 48*a*, the filter element 52*a* and the energy storage 84*a*. The housing unit 58*a* serves for a protection and an orientation of the fan 48*a*, the filter element 52*a* and the energy storage 84*a*. Furthermore, the energy storage 84*a* is implemented such that it is exchangeable via the cover 76*a* (FIG. 2, FIG. 3).

The respiratory protection system 10*a* further comprises an external operating unit 62*a*. The external operating unit

62*a* is embodied by a remote control. The operating unit 62*a* comprises operating elements 64*a* and a control and/or regulation unit 66*a* that is configured for a control and/or regulation of the blower device 14*a*. By way of example, the external operating unit 62*a* is connected to the blower device 14*a* via a cable 88*a*. The control and/or regulation unit 66*a* of the external operating unit 62*a* is in particular configured to actuate the control and/or regulation unit 86*a* of the blower device 14*a* depending on an input at the operating elements 64*a*. For example, a performance grade of the fan 48*a* can be adjusted via the operating elements 64*a*. Furthermore, the fan 48*a* can be activated or deactivated via the operating elements 64*a*. The external operating unit 62*a* further comprises a sensor unit 68*a* for capturing environmental parameters. The control and/or regulation unit 66*a* is configured, in at least one operation state, to control and/or regulate the blower device 14*a* on the basis of the environmental parameters. The control and/or regulation unit 66*a* is configured, in operation, to actuate the control and/or regulation unit 86*a* of the blower device 14*a*, a performance grade of the fan 48*a* being adapted via the control and/or regulation unit 86*a* of the blower device 14*a* on the basis of the environmental parameters. The sensor unit 68*a* is configured to capture an air quality, an ambient pressure and/or an oxygen concentration.

The respiratory protection system 10*a* further comprises a vest 60*a* that is to be worn by a user 18*a*. The vest 60*a* is embodied as a textile vest. On a rear side of the vest 60*a*, the blower device 14*a* is arranged. The blower device 14*a* is releasably connected to the vest 60*a*. During operation, the blower device 14*a* is worn by a user 18*a* on his back via the vest 60*a*. The external operating unit 62*a* is moreover configured to be worn by a user on his chest. The external operating unit 62*a* is arranged on a front side of the vest 60*a*. Therefore, environmental parameters can be captured by means of the sensor unit 68*a* in particular in a head region of the user 18*a*.

The respiratory protection system 10*a* further comprises a breathing air line 46*a*, which is connected to the blower device 14*a* and is configured for guiding the breathing air flow 26*a*. The breathing air line 46*a* connects the blower device 14*a* to the mouth protection device 12*a*. The breathing air line 46*a* is connected to the blower device 14*a* via the air outlet opening 80*a* of the blower device 14*a*. The breathing air line 46*a* is embodied by a tube. In operation, the breathing air line 46*a* is configured for guiding the breathing air flow 26*a*.

The mouth protection device 12*a* comprises a mask base body 16*a*. The mask base body 16*a* is configured to cover a mouth and nose region of the user 18*a*. Beyond this the mask base body 16*a* is configured to at least partially delimit a breathing zone 20*a*. In operation, the mask base body 16*a*, together with the face of the user 18*a* and a separating layer 38*a*, delimits the breathing zone 20*a*. The mask base body 16*a* is made at least largely of a flexurally soft material. The mask base body 16*a* is made completely of a flexurally soft material. The mask base body 16*a* is made completely of a dimensionally instable material. The mask base body 16*a* is made at least largely of a textile material. The mask base body 16*a* is completely made of a textile material. The mask base body 16*a* is made of a textile. The mask base body 16*a* is completely made of a textile. The mask base body 16*a* is implemented so as to be at least substantially airtight. It would in particular be conceivable that a textile which the mask base body 16*a* is made of has a coating which at least reduces air-permeability. The mask base body 16*a* is in particular airtight at least at an absolute pressure of 1 bar, preferably at least 2 bar and particularly preferentially at least 3 bar (FIG. 4).

The mouth protection device 12*a* further comprises a sealing element 90*a*. The sealing element 90*a* is fixedly connected to the mask base body 16*a*. The sealing element 90*a* is arranged at an upper edge of the mask base body 16*a*. The sealing element 90*a* is configured to seal the mask base body 16*a*, at least at an upper edge of the mask base body 16*a*, against the face of a user 18*a*. The sealing element 90*a* is configured to seal the breathing zone 20*a* and an outlet region 40*a* toward the eyes of the user 18*a* in order to avoid an airflow into the eyes of the user 18*a*. The sealing element 90*a* is made of a foam material. The sealing element 90*a* is realized by a foam material strip. By way of example, the sealing element 90*a* is glued with the mask base body 16*a* (FIG. 6).

The mouth protection device 12*a* further comprises a breathing air supply line 22*a* which is connected with the mask base body 16*a*. The breathing air supply line 22*a* delimits a breathing air channel 24*a*, which ends in the breathing zone 20*a* and is configured for guiding the active breathing air flow 26*a*. The breathing air supply line 22*a* is implemented by an elastic tube. By way of example, the breathing air supply line 22*a* has an oval cross section. However, a different cross section of the breathing air supply line 22*a*, deemed expedient by someone skilled in the art, would also be conceivable, like for example a circular cross section. The breathing air supply line 22*a* extends from the breathing air line 46*a* to the breathing air zone 20*a*.

Furthermore, the mouth protection device 12*a* comprises a further breathing air supply line 22'*a*, which is redundant to the breathing air supply line 22*a* and is connected to the mask base body 16*a*. The further breathing air supply line 22'*a* delimits a further breathing air channel, which ends in the breathing zone 20*a* and is configured for guiding an active breathing air flow 26*a*. The further breathing air supply line 22'*a* is implemented by an elastic tube. By way of example, the further breathing air supply line 22'*a* has an oval cross section. The further breathing air supply line 22'*a* extends from the breathing air line 46*a* to the breathing zone 20*a*. The further breathing air supply line 22'*a* is arranged on a side of the mask base body 16*a* that faces away from the breathing air supply line 22*a*. The breathing air supply lines 22*a*, 22'*a* are configured to be guided along on different sides of the head 30*a* of the user 18*a*. The further breathing air supply line 22'*a* has a function that is redundant to the breathing air supply line 22*a*. The further breathing air supply line 22'*a* serves for augmenting safety of a supply with the breathing air flow 26*a*. The breathing air supply line 22*a* and the further breathing air supply line 22'*a* are respectively functional independently from each other.

The breathing air line 46*a* that is connected with the blower device 14*a* is configured for guiding the breathing air flow 26*a* to the breathing air supply lines 22*a*, 22'*a*. The breathing air line 46*a* is furthermore configured to divide the breathing air flow 26*a* to the breathing air supply line 22*a* and the further breathing air supply line 22'*a*. The breathing air line 46*a* is coupled with the breathing air supply line 22*a* and the further breathing air supply line 22'*a* via a T-connection piece 108*a*. The T-connection piece 108*a* is configured to be arranged in a nape region of the user 18*a*.

Beyond this the mouth protection device 12*a* further comprises a fastening strap 28*a* for fixing the mask base body 16*a* on the head 30*a* of the user 18*a*. The fastening strap 28*a* is embodied as an elastic strap, like in particular a rubber strap. The fastening strap 28*a* has a width corresponding at least approximately to a width of the breathing air supply line 22*a*. Furthermore, an effective length of the fastening strap 28*a* is realized so as to be adjustable. The fastening strap 28*a* extends from a first end of the mask base body 16*a* to an opposite-situated second end of the mask base body 16*a*. The fastening strap 28*a* extends from a first end of the mask base body 16*a*, in which the breathing air supply line 22*a* is connected with the mask base body 16*a*, to an opposite-situated second end of the mask base body 16*a*, in which the further breathing air supply line 22'*a* is connected with the mask base body 16*a*. In a state when the mouth protection device 12*a* is worn, the fastening strap 28*a* is configured to be guided around an occiput, in particular in a nape region. The mouth protection device 12*a* comprises at least one connection unit 32*a* for a simultaneous plug-in connection of the fastening strap 28*a* and the at least one breathing air supply line 22*a*, 22'*a* with the mask base body 16*a*. The mouth protection device 12*a* comprises the connection unit 32*a* and a further connection unit, which is not shown in detail, for a simultaneous plug-in connection of the fastening strap 28*a* with the breathing air supply line 22*a* and the further breathing air supply line 22'*a*, respectively, and with the mask base body 16*a*. The connection units 32*a* serve for pulling off or putting off the mouth protection device 12*a*. With the connection units 32*a*, a coupling is brought about for example via a plug-in movement. The connection units 32*a* in each case comprise a first coupling element 92*a* and a second coupling element 94*a* corresponding to the first coupling element 92*a*. The first coupling elements 92*a* of the connection units 32*a* exemplarily form in each case an interface receptacle, while the second coupling elements 94*a* of the connection units 32*a* in each case form an interface projection. The first coupling elements 92*a* of the connection units 32*a* are fixedly connected with the mask base body 16*a* at opposite ends respectively. The second coupling element 94*a* of the connection unit 32*a* is implemented fixedly with a first end of the fastening strap 28*a* and the breathing air supply line 22*a*. The further second coupling element of the further connection unit is implemented fixedly with a second end of the fastening strap 28*a* and the further breathing air supply line 22'*a*. The first coupling elements 92*a* of the connection units 32*a* are respectively implemented by a tube connection. The first coupling elements 92*a* of the connection units 32*a* are respectively configured to latch with the second coupling elements 94*a* of the connection units 32*a*. The second coupling elements 94*a* of the connection units 32*a* in each case comprise actuation elements 96*a* for releasing the latch connection (FIGS. 1, 5).

The mouth protection device 12*a* comprises a head-fastening strap 98*a* for an additional fixing of the mask base body 16*a* on the head 30*a* of the user 18*a*. Furthermore, an effective length of the head-fastening strap 98*a* is implemented so as to be adjustable. The head-fastening strap 98*a* extends from a first end of the mask base body 16*a* to an opposite-situated second end of the mask base body 16*a*. The head-fastening strap 98*a* extends from a first end of the mask base body 16*a*, in which the breathing air supply line 22*a* is connected with the mask base body 16*a*, to an opposite-situated second end of the mask base body 16*a*, in which the further breathing air supply line 22'*a* is connected with the mask base body 16*a*. In a state when the mouth protection device 12*a* is worn, the head-fastening strap 98*a* is configured to be guided around an occiput, particular an upper head. The mouth protection device 12*a* comprises a fastening unit 100*a* and a further fastening unit 100'*a* for an adjustable fastening of the head-fastening strap 98*a* with the mask base body 16*a* on said ends. For fastening, the head-fastening strap 98*a* is guided adjustably through recesses at the fastening units 100*a*, 100'*a*.

The mouth protection device 12*a* further comprises an adjusting unit 34*a*, by means of which at least an effective length of a side edge 36*a* of the mask base body 16*a* is implemented so as to be adjustable. By means of the adjusting unit 34*a*, an effective length of a side edge 36*a* is implemented so as to be adjustable from the first end of the mask base body 16*a*, in which the first coupling element 92*a* is arranged, to the second end of the mask base body 16*a*, in which the further first coupling element 92'*a* is arranged. The side edge 36*a* extends substantially parallel to a main extent direction of the mask base body 16*a*. The adjusting unit 34*a* comprises a cord 102*a*, in particular an elastic cord, and a cord clamp 104*a*. The cord 102*a* of the adjusting unit 34*a* extends in a channel of the mask base body 16*a* from the first end of the mask base body 16*a* to the second end of the mask base body 16*a*, which is situated opposite the first end. The cord 102*a* is fastened on the first end and on the second end. An effective length of the cord 102*a*, and thus also of the side edge 36*a* of the mask base body 16*a*, is implemented so as to be manually adjustable via the cord clamp 104*a*. In particular, an effective length of the cord 102*a* is implemented so as to be manually adjustable via the cord clamp 104*a* by the formation of different-sized loops of the cord 102*a*.

The mouth protection device 12*a* further comprises a separating layer 38*a*, which is connected with the mask base body 16*a* and is configured for an at least partial separation of the breathing zone 20*a* from an outlet region 40*a*. The outlet region 40*a* is at least partly delimited by the mask base body 16*a*. The outlet region 40*a* is arranged below the breathing zone 20*a*. In an operation state, the mask base body 16*a* delimits, together with the face of the user 18*a*, a spatial region that is divided into a breathing zone 20*a* and an outlet region 40*a* by means of the separating layer 38*a*. The separating layer 38*a* forms, together with the mask base body 16*a*, a channel which at least partly forms the breathing zone 20*a* and extends as far as a middle region of the mouth protection device 12*a*. The channel formed by the separating layer 38*a* extends from the breathing air channel 24*a* and the further breathing air channel as far as a user's mouth and/or nose region. In the user's mouth and/or nose region, the breathing zone 20*a* merges into the outlet region 40*a*. The separating layer 38*a* is implemented integrally with the mask base body 16*a*. The separating layer 38*a* protrudes perpendicularly to the mask base body 16*a* between the breathing zone 20*a* and the outlet region 40*a*. The separating layer 38*a* has in a middle region a recess 106*a* connecting the breathing zone 20*a* to the outlet region 40*a*. The separating layer 38*a* is implemented at least substantially of a textile material. The separating layer 38*a* is completely made of a textile. The separating layer 38*a* is configured for a defined air guidance. The separating layer 38*a* is configured to guide the breathing air flow 26*a* past the mouth and/or nose region of a user 18*a* before it reaches the outlet region 40*a*. For this purpose, the separating layer 38*a* has in its middle region the recess 106*a*, which connects the breathing zone 20*a* to the outlet region 40*a*. In operation, the breathing air flow 26*a* flows from the breathing air channel 24*a* and the further breathing air channel into the breathing zone 20*a* and from the breathing air zone 20*a* through the recess 106*a* into the outlet region 40*a*. The recess 106*a* is arranged in a proximity of the mouth and/or nose region of a user 18*a* (FIG. 6).

Beyond this the mouth protection device 12*a* comprises a discharge valve 42*a,* which is configured to regulate a pressure in the breathing zone 20*a* to an at least approximately constant value. The discharge valve 42*a* is implemented by an overpressure valve, in particular a one-way overpressure valve, which is configured to open if a defined overpressure is exceeded in the breathing zone 20*a,* respectively the outlet region 40*a,* relative to an environment. The discharge valve 42*a* is configured to permit, in particular maintain, a defined overpressure in the breathing zone 20*a.* Preferably the discharge valve 42*a* is implemented by a mechanical valve. The mask base body 16*a* is not completely sealed with respect to the face of the user 18*a,* such that air may also leave at a transition from the mask base body 16*a* to the face, besides the discharge valve 42*a.*

If at the transition from the mask base body 16*a* to the face there is too much leakage or if the mouth protection device 12*a* is taken off, it is no longer possible for the pressure in the breathing zone 20*a* to be maintained and the pressure drops below the limit value of the discharge valve 42*a.* This may be detected by the blower device 14*a,* in particular by a load of the fan 48*a,* and if applicable a warning signal may be given to the user 18*a.* In this way faulty wearing of the mouth protection device 12*a* can be indicated to the user 18*a* automatically. Furthermore, the fan 48*a* may thus stop automatically when the mouth protection device 12*a* is put on. Under regular conditions the pressure in the breathing zone 20*a* is regulated to an approximately constant value by means of the discharge valve 42*a* (FIG. 4).

It is also conceivable that the mask base body 16*a* comprises a subregion 44*a* which is implemented in an air-permeable fashion. The subregion 44*a* is in particular made of an air-permeable textile. The subregion 44*a* directly adjoins the outlet region 40*a.* The subregion 44*a* serves for a defined discharge of air in the outlet region 40*a.* The subregion 44*a* is provided in addition to the discharge valve 42*a;* it would however also be conceivable that only the subregion 44*a* is provided, the subregion 44*a* taking on the function of the discharge valve 42*a.*

In FIG. 7 a further exemplary embodiment of the invention is shown. The following description is essentially limited to the differences between the exemplary embodiments, wherein regarding components, features and functions that remain the same, the description of the exemplary embodiment of FIGS. 1 to 6 may be referred to. In order to distinguish between the exemplary embodiments, the letter a that was added to the reference numerals of the exemplary embodiment of FIGS. 1 to 6 has been replaced by the letter b in the reference numerals of the exemplary embodiment of FIG. 7. Regarding components having the same denomination, in particular regarding components having the same reference numerals, the drawings and/or the description of the exemplary embodiment of FIGS. 1 to 6 may principally be referred to.

FIG. 7 shows a blower device 14*b* of a respiratory protection system. The blower device 14*b* is configured for a generation of a breathing air flow 26*b.* The blower device 14*b* is configured for a generation of a breathing air flow 26*b* for a mouth protection device.

The blower device 14*b* comprises a housing unit 58*b.* The housing unit 58*b* is implemented by a plastic housing. The housing unit 58*b* comprises two interconnected housing shells 70*b,* 72*b,* namely a first housing shell 70*b* and a second housing shell 72*b.* The housing unit 58*b* has a thickness d of less than 70 mm.

The blower device 14*b* further comprises a fan 48*b* for generating an airflow 50*b.* The blower device 14*b* is configured to create an overpressure in the mouth protection device 12*b.* The fan 48*b* is configured to create an overpressure in the mouth protection device 12*b.* The fan 48*b* is implemented by an electrical radial fan.

The blower device 14*b* further comprises a filter element 52*b.* The filter element 52*b* is configured to be flown through by the airflow 50*b.* The filter element 52*b* is implemented by a rectangular-cuboid-shaped filter module. The filter element 52*b* is implemented by an aerosol filter. The filter element 52*b* is embodied as a depth filter, in particular as a lamellate filter. A main extent plane 54*b* of the filter element 52*b* extends at least substantially parallel to a main extent plane of the housing unit 58*b.* The filter element 52*b* is arranged in a lower region of the blower device 14*b.* The housing unit 58*b* accommodates the fan 48*b* and the filter element 52*b.*

Furthermore the blower device 14*b* comprises a further filter element 52'*b.* The further filter element 52'*b* is configured to be flown through by the airflow 50*b.* The further filter element 52'*b* is configured to be flown through by the airflow 50*b* before the filter element 52*b.* The further filter element 52'*b* is implemented by a rectangular-cuboid-shaped filter module. The further filter element 52'*b* is implemented by an activated-carbon odor filter. A main extent plane 54'*b* of the further filter element 52'*b* extends at least substantially parallel to a main extent plane of the housing unit 58*b.* The further filter element 52'*b* is arranged in a lower region of the blower device 14*b.* The housing unit 58*b* accommodates the fan 48*b,* the filter element 52*b* and the further filter element 52'*b.* Air inlet openings 78*b* are arranged on an entry side of the further filter element 52'*b.* The further filter element 52'*b* is arranged on an entry side of the filter element 52*b.*

The fan 48*b* is arranged next to the filter element 52*b,* the airflow 50*b* being deflected between the fan 48*b* and the filter element 52*b.* The further filter element 52'*b* is also arranged next to the fan 48*b.* The filter element 52*b,* the further filter element 52'*b* and the fan 48*b* are together arranged in the housing unit 58*b.*

The housing unit 58*b* further comprises an air conveying channel 82*b,* which accommodates the filter element 52*b* and the further filter element 52'*b* and is configured for guiding the airflow 50*b* between the filter element 52*b* and the fan 48*b.*

The filter element 52*b* and the further filter element 52'*b* are arranged in a stacked fashion. The filter element 52*b* is arranged along the airflow 50*b* fluidically upstream of the fan 48*b.* The further filter element 52'*b* is arranged along the airflow 50*b* fluidically upstream of the filter element 52*b.* The airflow 50*b* between the fan 48*b* and the filter element 52*b* is deflected by at least approximately 90°. A deflection of the airflow 50*b* is brought about in the air conveying channel 82*b.* It would however also be conceivable that an air conveying channel 82*b* can be dispensed with. A flow-through direction $r_1$ of the airflow 50*b* through the filter element 52*b* is substantially different from a flow-through direction $r_2$ of the airflow 50*b* through the fan 48*b.* A flow-through direction $r_3$ of the airflow 50*b* through the further filter element 52'*b* is substantially different from the flow-through direction $r_2$ of the airflow 50*b* through the fan 48*b.* The flow-through direction $r_3$ of the airflow 50*b* through the further filter element 52'*b* corresponds essentially to the flow-through direction $r_1$ of the airflow 50*b* through the filter element 52*b.* The flow-through direction $r_2$ of the airflow 50*b* through the fan 48*b* runs parallel to a main extent plane 56*b* of the fan 48*b.* The flow-through direction $r_1$ of the airflow 50*b* through the filter element 52*b* runs perpendicularly to the main extent plane 54*b* of the filter element 52*b*. The flow-through direction $r_3$ of the airflow 50*b* through the further filter element 52'*b* runs perpendicularly to the main extent plane 54'*b* of the further filter element 52'*b*. The flow-through direction $r_1$ of the filter element 52*b* and the flow-through direction $r_3$ of the further filter element 52'*b* are angled by at least approximately 90° relative to the flow-through direction $r_2$ of the fan 48*b*.

REFERENCE NUMERALS

10*a* respiratory protection system
12*a* mouth protection device
14*a*, 14*b* blower device
16*a* mask base body
18*a* user
20*a* breathing zone
22*a* breathing air supply line
22'*a* breathing air supply line
24*a* breathing air channel
24'*a* breathing air channel
26*a*, 26*b* breathing air flow
28*a* fastening strap
30*a* head
32*a* connection unit
32'*a* connection unit
34*a* adjusting unit
36*a* side edge
38*a* separating layer
40*a* outlet region
42*a* discharge valve
42'*a* discharge valve
44*a* subregion
46*a* breathing air line
48*a*, 48*b* fan
50*a*, 50*b* airflow
52*a*, 52*b* filter element
52'*a*, 52'*b* filter element
54*a*, 54*b* main extent plane
54'*a*, 54'*b* main extent plane
56*a*, 56*b* main extent plane
58*a*, 58*b* housing unit
60*a* vest
62*a* operating unit
64*a* operating element
66*a* control and/or regulation unit
68*a* sensor unit
70*a*, 70*b* housing shell
72*a*, 72*b* housing shell
74*a* cover
76*a* cover
78*a*, 78*b* air inlet opening
80*a*, 80*b* air outlet opening
82*a*, 82*b* air conveying channel
84*a*, 84*b* energy storage
86*a* control and/or regulation unit
88*a* cable
90*a* sealing element
92*a* coupling element
94*a* coupling element
96*a* actuation element
98*a* head-fastening strap
100*a* fastening unit
100'*a* fastening unit
102*a* cord
104*a* cord clamp
106*a* recess
108*a* T-connection piece
d thickness
$r_1$ flow-through direction
$r_2$ flow-through direction
$r_3$ flow-through direction

The invention claimed is:

1. A mouth protection device for a blower respiratory protection system with a mask base body which is configured to cover a mouth and/or nose region of a user and which delimits a breathing zone at least partially, and with at least one breathing air supply line, which is connected to the mask base body and delimits at least one breathing air channel that ends in the breathing zone and is configured for guiding an active breathing air flow, wherein the mask base body is made at least largely of a flexurally soft material, the mask base body being made at least largely of a textile material, comprising at least one adjusting unit, wherein at least an effective length of a side edge of the mask base body is implemented so as to be at least partially adjustable by means of the adjusting unit, wherein the effective length of the side edge is implemented so as to be adjustable by the adjusting unit from a first end of the mask base body, in which a first coupling element of a connection unit is arranged, to a second end of the mask base body, in which a further first coupling element of the connection unit is arranged, the side edge extending substantially parallel to a main extent direction of the mask base body, wherein the adjusting unit comprises an elastic cord, and a cord clamp, the cord of the adjusting unit extending in a channel of the mask base body from the first end of the mask base body to the second end of the mask base body, which is situated opposite the first end, the cord being fastened on the first end and on the second end, wherein an effective length of the cord, and thus of the side edge of the mask base body, is implemented so as to be manually adjustable via the cord clamp.

2. The mouth protection device according to claim 1, comprising at least one further breathing air supply line, which is redundant to the breathing air supply line, which is connected with the mask base body and which delimits at least one further breathing air channel that ends in the breathing zone and is configured for guiding the active breathing air flow.

3. The mouth protection device according to claim 2, wherein the at least one further breathing air supply line is arranged on a side of the mask base body that faces away from the breathing air supply line.

4. The mouth protection device according to claim 1, comprising at least one fastening strap for fixing the mask base body on the head of the user, and the connection unit for a simultaneous plug-in connection of the fastening strap and the at least one breathing air supply line with the mask base body.

5. The mouth protection device according to claim 1, comprising at least one separating layer, which is connected to the mask base body and is configured to at least partially separate the breathing zone from an outlet region, the outlet region being at least partially delimited by the mask base body.

6. The mouth protection device according to claim 5, wherein the separating layer is at least substantially made of a textile material.

7. The mouth protection device according to claim 5, wherein the separating layer is configured for a defined air guidance, wherein the separating layer is configured to guide the breathing air flow past the mouth and/or nose region of a user before the breathing air flow reaches the outlet region.

8. The mouth protection device according to claim 1, comprising at least one discharge valve, which is configured to regulate a pressure in the breathing zone to an at least approximately constant value.

9. The mouth protection device according to claim 1, wherein the mask base body comprises at least one subregion is implemented so as to be air-permeable.

10. A blower respiratory protection system with the mouth protection device according to claim 1, and with at least one blower device for a generation of the breathing air flow.

11. The respiratory protection system according to claim 10, wherein the at least one blower device is configured to create an overpressure in the mouth protection device.

12. The respiratory protection system according to claim 10, wherein the at least one blower device is configured to create a volume flow of the breathing air flow of at least 50 l/min and maximally 250 l/min.

13. The respiratory protection system according to claim 10, comprising at least one breathing air line, which is connected with the at least one blower device, which is configured to guide the breathing air flow and is configured to divide the breathing air flow to the at least one breathing air supply line and a further breathing air supply line.

* * * * *